United States Patent [19]

Claybaugh

[11] 3,970,594

[45] July 20, 1976

[54] HARD SURFACE CLEANING COMPOSITIONS

[75] Inventor: Gene W. Claybaugh, Cincinnati, Ohio

[73] Assignee: The Procter & Gamble Company, Cincinnati, Ohio

[22] Filed: Mar. 18, 1975

[21] Appl. No.: 559,461

[52] U.S. Cl. ..... 252/524; 252/89 R; 252/135; 252/542; 252/DIG. 2; 252/DIG. 15

[51] Int. Cl.[2] ..... C11D 3/37

[58] Field of Search ..... 252/DIG. 2, DIG. 15, 252/524, 542, 135, 89, 540, 531, 532, 539, 99

[56] References Cited

UNITED STATES PATENTS

| | | | |
|---|---|---|---|
| 3,144,412 | 8/1964 | Inamorato | 252/DIG. 15 X |
| 3,318,816 | 5/1967 | Trowbridge | 252/DIG. 15 X |
| 3,576,760 | 4/1971 | Gould et al. | 252/89 X |

*Primary Examiner*—Harris A. Pitlick
*Attorney, Agent, or Firm*—George W. Allen; Douglas C. Mohl; Richard C. Witte

[57] ABSTRACT

Hard surface cleaning compositions containing low levels of a mixture of polyvinyl alcohol or polyvinyl pyrrolidone in combination with polysaccharide salts provide unexpectedly improved soil removal.

10 Claims, No Drawings

HARD SURFACE CLEANING COMPOSITIONS

BACKGROUND OF THE INVENTION

This invention relates to hard surface cleaning compositions having improved soil removal capabilities. More particularly, this invention relates to built hard surface cleaning compositions having low levels of surfactant in combination with low levels of the mixture of certain primary polymeric materials with polysaccharide salts.

Hard surface cleaning compositions are a class of detergent compositions adapted to meet the variety of requirements necessary for overall optimum performance in hard surface cleaning usage. Examples of such hard surface cleaning compositions appear in U.S. Pat. No. 3,223,646, issued Dec. 14, 1965 to McKenna et al, and entitled "DRY FREE-FLOWING DETERGENT COMPOSITION AND METHOD OF PREPARATION" and U.S. Pat. No. 3,591,509, issued July 6, 1971 to Parks et al, and entitled "LIQUID HARD SURFACE CLEANING COMPOSITIONS".

Generally, granular hard surface cleaning compositions contain less than 5% by weight surfactant (often considerably less) and often have very high levels of organic and inorganic builders. Liquid hard surface cleaning compositions generally contain from about 0.05% to about 15% surfactant, by weight with up to 25% builders. Hard surface cleaning compositions are formulated in this way for a number of reasons related to theuniqueperformancerequirementsinvolvedin hard surfacecleaning.

Forexample,hardsurfacecleaningcompositions mustpossessthecapabilityofremovinghighly substantive soils from many different types of hard surfaces without damage to the surface or danger to the user. Moreover,these compositions should notleave streaks or noticeable film on the surface after the soil is removed. Still further, the compositions must not produce excessive foam in use since foam can be time and effort consuming to remove. Even further such compositions must be stable over a relatively long period of time and under a variety of conditions including temperature and humidity changes. In short, realization of optimum hard surface cleaning compositions has required extensive and inventive efforts to provide maximum cleaning efficacy within the constraints of economically suitable and conveniently employed, finished end products.

Co-pending application Ser. No. 559,460, filed on even date herewith by Claybaugh (P&G Attorney Docket No. 2187) entitled "HARD SURFACE CLEANING COMPOSITIONS" incorporated herein by reference, describes granular hard surface cleaning compositions containing certain of the polyvinyl alcohol and polyvinyl pyrrolidone polymeric materials which are also useful herein. The invention herein is directed to the further inclusion of certain polysaccharide materials into liquid or granular hard surface cleaning compositions.

Polymers including polysaccharides have been used for a variety of purposes in detergents. Examples of such uses are disclosed in british Patent Specification 994,353, issued June 2, 1965 to Domestos, and entitled "IMPROVEMENTS IN DETERGENT COMPOSITIONS"; U.S. Pat. No. 2,798,047 issued July 2, 1957 to Touey et al and entitled "DETERGENT COMPOSITIONS FOR LAUNDERING TEXTILE FABRICS, CONTAINING A COPOLYMER OF A LOWER N-ALKYL ACRYLAMIDE AND VINYL ALCOHOL"; U.S. Pat. No. 3,846,324, issued Nov. 5, 1974 to Lohmann et al, and entitled "DETERGENTS"; U.S. Pat. No. 3,676,352, issued July 11, 1972 to Grimm et al, and entitled "PROCESS FOR THE MANUFACTURE OF ENZYME AND PERBORATE CONTAINING DETERGENT COMPOSITIONS"; U.S. Pat. No. 3,558,499, issued Jan. 26, 1971 to Galvin et al, and entitled "ANTI-REDEPOSITION AGENTS;" and South African Application 72/2050, filed Mar. 27, 1972 by Hampson et al, and entitled "LIQUID COMPOSITIONS."

Although, as such references demonstrate, polymers have been used in detergents for a variety of purposes, it is believed that the beneficial use of the combination of certain primary polymeric materials with polysaccharide salts according to the present invention has not heretofore been recognized.

Surprisingly, it has been discovered that these materials can provide improved soil removal when incorporated into hard surface cleaning compositions and, furthermore, can be used to encapsulate and protect unstable and/or volatile detergent adjuvants within the hard surface cleaning composition.

Accordingly, an object of the present invention is to provide improved hard surface cleaning compositions through the beneficial use of certain polymeric materials with polysaccharide salt materials.

It is a further object of the present invention to improve soil removal capabilities of hard surface cleaning compositions.

It is still a further object of the instant invention to incorporate into hard surface cleaning compositions a combination of materials which serves both to improve soil removal capabilities of the compositions and to usefully encapsulate and preserve detergent composition adjuvants within the hard surface cleaning products.

These and other objects are achieved as hereinafter disclosed.

SUMMARY OF THE INVENTION

The instant invention relates to low surfactant, built hard surface cleaning compositions. Such compositions comprise from about 0.05% to about 15% by weight surfactant (preferably from about 0.5% to less than 5%), from about 0.5% to about 99% by weight builder (preferably from about 25% to about 99% in granular compositions and preferably from about 0.5% to 25% in liquid compositions), and from about 0.03% to about 5.0% (preferably from about 0.04% to about 2.0%) by weight of a soil removal improvement mixture.

The surfactant component can be any conventional anionic, nonionic, ampholytic or zwitterionic surfactant. The builder can be any conventional organic or inorganic builder salt or salt mixture.

The soil removal improvement mixture comprises the combination of certain water-soluble or dispersible primary polymeric materials which are nonionizing in water with ionizing polysaccharide salts in a weight ratio of primary polymeric material to polysaccharide salt of from about 4:1 to about 1:4 (preferably from about 2:1 to about 1:2).

The primary polymeric material component of the soil removal mixture comprises water-soluble or dispersible nonionizing polymers such as polyvinyl alcohol (degree of hydrolysis 60% to 100%; degree of polymerization 100 to 7000); and polyvinyl pyrrolidone (degree of polymerization 50 to 6000); or mixtures of these polymer types.

The polysaccharide salt component comprises ionizing polysaccharides which have recurrent acidic moieties which have been at least in part neutralized.

The instant invention also relates to a method for removing soil from hard surfaces. Such a method comprises contacting the soiled surface with an effective amount of an aqueous solution of a composition as described above and oscillating such a solution over the surface to remove the soil.

DETAILED DESCRIPTION OF THE INVENTION

This invention is directed to hard surface cleaning compositions which provide improved cleaning performance by the incorporation of a mixture of certain water-soluble or water-dispersible primary polymeric materials with polysaccharide salts. Essential components of such compositions are the primary polymeric material, polysaccharide salt, surfactant, and builder. The primary polymeric material and polysaccharide salt in certain weight ratios comprise a soil removal improvement mixture. These and other invention aspects are described in detail as follows.

SOIL REMOVAL IMPROVEMENT MIXTURE

Utilization of a certain soil removal improvement mixture comprising a mixture of primary polymeric material and polysaccharide salts in hard surface cleaning compositions unexpectedly improves the capability of the compositions to remove soils from hard surfaces. The soil removal mixture is added to the hard surface cleaning composition at levels of from about 0.03% to about 5.0% by weight, preferably from about 0.04% to about 2.0%. The weight ratio of the nonionizing primary polymeric material to the ionizing polysaccharide salt within the soil removal improvement mixture varies from about 4:1 to about 1:4, preferably from about 2:1 to about 1:2. The primary polymeric materials and polysaccharide salts are described below.

a. Primary Polymeric Material

The primary or nonionizing polymeric materials include specific types of polyvinyl alcohol and polyvinyl pyrrolidone. Both types of polymeric materials used herein are water-soluble or water-dispersible and are nonionizing in water.

Polyvinyl alcohol is the preferred primary polymeric material for use in the instant composition. Polyvinyl alcohol is a well-known polymer having the repeating monomeric unit $(-CH_2CHOH-)_x$. Polyvinyl alcohols are normally prepared by hydrolysis of polyvinyl acetate. The polyvinyl alcohol operable herein includes polyvinyl acetate polymers in which at least 60%, preferably 80% to 100% (most preferably 97% to 100%) of the acetate moieties are replaced by hydroxyl moieties. For simplicity, such polyvinyl alcohol materials are referred to herein as polyvinyl alcohol having at least 60% degree of hydrolysis, preferably at least about 80% to 100% degree of hydrolysis. Most preferred polyvinyl alcohols have a degree of hydrolysis of 97% to 100%.

Operable polyvinyl alcohols further include those which have a degree of polymerization of from about 100 to about 7,000, preferably from about 200 to 3500.

Polyvinyl alcohols are available commercially. Examples of such commercially available polyvinyl alcohols suitable for use herein are Elvanols marketed by E. I. Dupont and Company and Gelvatols marketed by Monsanto Company. These commercially available materials are often described with a molecular weight and a viscosity instead of in terms of degree of hydrolysis and polymerization. Accordingly, useful commercially available polyvinyl alcohols include those which have a molecular weight from about 4,500 to about 300,000, preferably from about 9,000 to about 150,000, and a viscosity (of a 4% aqueous solution at 20°C) of from about 3 centipose to about 100 centipose, preferably from about 4 centipose to about 50 centipose. Polyvinyl alcohol materials are described in more detail at pages 72 to 81 of the text, Handbook of Common Polymers compiled by Roff et al, Butterworth & Co. (Publishers), 1971 and Polyvinyl Alcohol - Properties and Applications edited by C. A. Finch, John Wiley and Sons (Publishers), 1973, both books being incorporated herein by reference.

Another type of primary polymeric material operable in the soil removal improvement mixture of the instant compositions is polyvinyl pyrrolidone. Chemically, polyvinyl pyrrolidones are homopolymers of N-vinylpyrrolidone. The repeating monomer is of the following structure:

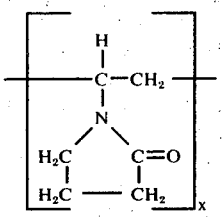

Polyvinyl pyrrolidones having a degree of polymerization of from about 50 to about 6,000, preferably about 90 to 3,500 are useful in the soil removal improvement mixture of the hard surface cleaning compositions of the present invention.

Examples of commercially available polyvinyl pyrrolidones include Plasdone marketed by GAF Corp. and Albigen A marketed by BASF Corp. These commercially available materials are also often described in terms of polymer molecular weights. Accordingly, commercially useful polyvinyl pyrrolidones include those having molecular weights of from about 10,000 to about 360,000.

Either of the two above-described types of nonionizing polymeric materials can be used alone in the soil removal improvement mixture of the present invention. As noted polyvinyl alcohols are the preferred materials. Mixtures of the two types of primary polymeric materials can also be employed in the soil removal improvement mixture.

b. Polysaccharide Salt

The second essential component of the soil removal improvement mixture comprises a polysaccharide salt material having a molecular weight of at least about 4,000 up to as much as 5,000,000 or more and a propensity to ionize in aqueous solution. Such polysaccharide salts can either be naturally occurring or derived and are either fully or partially neutralized acidic polysaccharides.

Preferred polysaccharide salts useful herein can be in the alkali metal, alkaline earth metal or ammonium form. Thus, sodium, potassium, calcium, magnesium and ammonium polysaccharides are preferred in the soil removal improvement mixture.

Useful naturally occurring acidic polysaccharides and their salts include those obtained, for example, from seaweed extracts (e.g. algin); plant exudates (e.g. gum arabic); seed gums (e.g. guar gum); plant extracts (e.g. pectin) or animal extracts.

Preferred naturally occurring polysaccharides are substantially linear polymers and have recurrent carboxylate functional groups which are at least in part neutralized. Algin, a seaweed extract, is an especially preferred polysaccharide salt.

Biosynthetic polysaccharides in salt form are also useful herein. Xanthan gum is an example of such a biosynthetic polysaccharide.

Polysaccharides (including starches and celluloses) which have been chemically modified to form ionizing polysaccharide salts are also useful herein. Examples of such modified polysaccharides include those disclosed in U.S. Pat. No. 3,784,475 issued Jan. 8, 1974 to Diehl and U.S. Pat. No. 3,629,121 issued Dec. 21, 1971 to Eldib. These two patents disclose carboxylated polysaccharides and are incorporated herein by reference. Other useful polysaccharide salts include such modified cellulose compounds as sodium carboxymethylcelluloses, generally known as CMC.

As can be seen, a wide variety of polysaccharide salts are readily available and can be usefully employed in the soil removal improvement mixture herein. Further examples of useful polysaccharide salts can be found in well-known texts as Industrial Gums - Polysaccharides and Their Derivatives, 2nd Edition, edited by Whistler et al (Academic Press, 1973).

It should be noted that the polysaccharide salts useful herein need not be water-soluble or dispersible per se but should be convertible to a water-soluble or dispersible form when added to water along with other components of the hard surface cleaning compositions herein. Thus the alkaline earth metal alginate materials, for example, are not water-soluble but when added to water with a detergent builder are converted to a water-soluble alginate form as the builder acts to sequester the alkaline earth metal and remove it from the alginate molecule.

Preferred polysaccharide salts include alkali metal and alkaline earth metal alginates, gum arabics, xanthan gums and carrageenans with alginates and xanthan gums most preferred. Low viscosity grades of sodium and calcium alginates are particularly preferred.

ORGANIC SURFACTANTS

The organic surfactant compounds which can be utilized in the present invention include anionic, nonionic, ampholytic, and zwitterionic surfactants. These surfactants are included at levels which inhibit undesirable foaming and surface streaking yet which provide advantageous removal of soils, particularly soils of lipophylic and particulate character. Surfactant is incorporated at from about 0.05% to about 15%, preferably from about 0.5% to less than 5% by weight of the instant compositions.

A. Anionic Soap and Non-Soap Synthetic Surfactants

This class of surfactants includes ordinary alkali metal soaps such as the sodium, potassium, ammonium and alkanol-ammonium salts of higher fatty acids containing from about 8 to about 24 carbon atoms and preferably from about 10 to about 20 carbon atoms. Suitable fatty acids can be obtained from natural sources such as, for instance, plant or animal esters (e.g., palm oil, coconut oil, babassu oil, soybean oil, castor oil, tallow, whale and fish oils, grease, lard, and mixtures thereof). The fatty acids also can be synthetically prepared (e.g., by the oxidation of petroleum, or by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap.

This class of anionic surfactants also includes water-soluble salts, particularly the alkali metal salts, of organic sulfuric reaction products having in their molecular structure an alkyl group containing from about 8 to about 22 carbon atoms and a sulfonic acid or sulfuric acid ester radical. (Included in the term alkyl is the alkyl portion of higher acyl groups.) Examples of this group of synthetic detergents which form a part of the built detergent compositions of the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 8 to 16 carbon atoms in straight chain or branched chain configuration, e.g. those of the type described in U.S. Pat. No. 2,220,099 and 2,477,383 (especially valuable are linear straight chain alkyl benzene sulfonates in which the average of the alkyl groups is about 11–12 carbon atoms and commonly abbreviated as $C_{11.8}$ LAS); sodium alkyl glyceryl ether sulfonates, especially those ethers of higher alcohols derived from tallow and coconut oil; sodium coconut oil fatty acid monoglyceride sulfonates and sulfates.

Other synethetic anionic surfactants useful herein are alkyl ether sulfates. These materials have the formula $RO(C_2H_4O)_xSO_3M$ wherein R is alkyl or alkenyl of about 10 to about 20 carbon atoms, x is 1 to 30, and M is a water-soluble cation as defined hereinbefore. The alkyl ether sulfates useful in the present invention are condensation products of ethylene oxide and monohydric alcohols having about 10 to about 20 carbon atoms. Preferably, R has 12 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 3 to 6, molar proportions of ethylene oxide and the resulting mixture of molecular species, having, for example, an average of 3 or 6 moles of ethylene oxide per mole of alcohol, is sulfated and neutralized.

Specific examples of alkyl ether sulfates of the present invention are sodium coconut alkyl ethylene glycol ether sulfate; lithium tallow alkyl triethylene glycol ether sulfate; sodium tallow alkyl hexaoxyethylene sulfate; and sodium tallow alkyl trioxyethylene sulfate. The alkyl ether sulfates are known compounds and are described in U.S. Pat. No. 3,332,876 to Walker (July 25, 1967), incorporated herein by reference.

Generally then, a wide variety of preferred anionic surfactants are useful in the instant compositions as providing the necessary detergency for hard surface cleaning. Most preferred anionic surfactants include $C_8$ to $C_{16}$ alkyl benzene sulfonates, $C_{12}$ to $C_{18}$ alkyl sulfates, and $C_{12}$ to $C_{18}$ ethoxylated alkyl sulfates having from 1 to 10 ethoxy moieties. For reasons of cleaning efficacy, economics and environmental compatibility, sodium linear alkyl benzene sulfonates having from 11 to 12 carbon atoms ($C_{11.8}$ avg.) in the alkyl portion are most particularly preferred, especially in combination with ethoxylated rosin acids such as tall oil which can be used as a spray-on antidusting agent in granular products.

B. Nonionic Synthetic Surfactants

Nonionic surface active agents operable in the instant compositions can be any of three basic types — the alkylene oxide condensates, the amides and the semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-7 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-100 and X-102, all marketed by the Rohm and Haas Company.

3. The condensation products of ethylene oxide with a hydrophobic base formed by the condensation of propylene oxide with propylene glycol. The hydrophobic portion of these compounds has a molecular weight of from about 1,500 to 1,800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surface active agent include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

Examples of the semi-polar type of nonionic surface active agents are the amine oxides, phosphine oxides and sulfoxides. These materials are described more fully in Berry, U.S. Pat. No. 3,819,528, issued June 25, 1974, incorporated herein by reference.

C. Ampholytic Synthetic Surfactants

Ampholytic synthetic detergents can be broadly described as derivatives of aliphatic amines which contain a long chain of about 8 to 18 carbon atoms and an anionic water-solubilizing group, e.g. carboxy, sulfo or sulfato. Examples of compounds falling within this definition are sodium 3-dodecylamino-propionate, sodium -3-dodecylamino propane sulfonate, and dodecyl dimethylammonium hexanoate.

D. Zwitterionic Synthetic Surfactants

Zwitterionic surface active agents operable in the instant composition are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono. Some of these zwitterionic surfactants are described in the following U.S. Pat. Nos.: 2,129,264; 2,178,353;

2,774,786; 2,813,898; and 2,828,332. The ammoniopropane sulfonates containing about 8 to about 21 carbon atoms are one class of surfactant compounds preferred herein by virtue of their relatively low calcium ion (hardness) sensitivity.

Of all the above described surfactants, anionic surfactants are the most preferred. An especially preferred anionic surfactant component comprises a mixture of sodium linear $C_{11-12}$ alkyl benzene sulfonate (LAS) and ethoxylated tall oil. Such a mixture is generally present in the instant composition in amounts such that the LAS comprises from about 0.05% to 3% by weight of the composition and the ethoxylated tall oil comprises from about 0.05% to about 0.5% by weight of the composition.

BUILDER SALTS

Builder salts are essential to the compositions herein and comprise from about 0.5% to about 99% by weight of the hard surface cleaning composition, preferably from 25% to about 99% by weight in granular compositions and from about 0.5% to 25% by weight in liquid compositions.

Suitable builders are water-soluble or water-dispersible in nature and comprise organic and inorganic salts. Mixtures of organic and inorganic can be employed. The phytate Suitable inorganic alkaline builder salts which can be used in this invention alone or in admixture include alkali metal carbonates, borates, phosphates, polyphosphates, bicarbonates, and silicates. Ammonium or substituted ammonium e.g., triethanol ammonium, salts of these materials can also be used. Specific examples of suitable salts are sodium tripolyphosphate, sodium carbonate, sodium tetraborate, sodium and potassium pyrophosphate, sodium and ammonium bicarbonate, potassium tripolyphosphate, sodium hexaphosphate, sodium sesquicarbonate, sodium orthophosphate, potassium bicarbonate. The preferred inorganic alkaline builders according to this invention are the alkali metal phosphates, carbonates, silicates, polyphosphates and sesquicarbonates.

Examples of suitable organic alkaline builder salts used in this invention alone or in admixture are alkali metal, ammonium or substituted ammonium aminocarboxylates, e.g., sodium and potassium ethylenediaminetetraacetate, sodium and potassium N-(2-hydroxyethyl)-ethylenediaminetriacetates, sodium and potassium nitrilotriacetates and sodium, potassium and triethanolammonium N-(2-hydroxyethyl)-nitrilodiacetates. Mixed salts of these polycarboxylates are also suitable. The alkali metal, ammonium and alkanol ammonium salts of citric acid can be suitably employed. the alkali metal salts of phytic acid, e.g. sodium The are also suitable as organic alkaline sequestrant builder salts.

Polyphosphonates are also valuable builders in terms of the present invention including specifically sodium and potassium salts of ethane-1-hydroxy-1,1-diphosphonic acid, sodium and potassium salts of methylene diphosphonic acid, and sodium and potassium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-1-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

Useful builders can be formulated to provide either phosphate-containing or phosphate-free cleaning compositions, although phosphate-containing compositions are preferred from the standpoint of soil removal and economics.

Preferred granular phosphate-containing hard surface cleaning compositions comprise by weight percent from about 5% to 65% alkali metal phosphate mixtures. These phosphate mixtures comprise from about 5% to 50% alkali metal polyphosphates and from about 0% to 30% alkali metal orthophosphates. The phosphate-containing hard surface cleaning compositions can further contain from about 25% to about 90% alkali metal carbonates (including sesquicarbonate) and from about 0% to 5% alkali metal silicates.

Preferred granular phosphate-free hard surface cleaning compositions contain on a weight basis from about 0.5% to about 25% organic builder salts, such as citrates, ethylenediamineacetates and nitritoacetates; from about 40% to about 95% alkali metal carbonates (including preferably 25% to about 90% sesquicarbonate), and from about 0% to 5% alkali metal silicates.

OPTIONAL INGREDIENTS

In addition to the above-described essential components the compositions of the instant invention can optionally contain such conventional detergent composition components as moisture (free or bound), fillers (neutral salts such as sodium sulfate), bleaches, hydrotropes, processing aids, enzymes, germicides, abrasives, perfumes and coloring agents. If present such components generally comprise from 0.5% up to 50% by weight of the composition especially if high levels of fillers are employed. Preferably, the compositions herein contain no bleach or enzyme which could be potentially deleterious to the surface being cleaned.

COMPOSITION PREPARATION

The compositions herein can be liquid or granular. Granular compositions can be prepared as follows.

a. Granular Compositions

The granular compositions of the instant invention can be prepared simply by admixing the essential and optional components together in granular form. Alternatively the surfactant, builder, and appropriate optional components including soil removal improvement mixture can be admixed with water in a crutcher and spray dried to granular form. Further amounts of soil removal improvement mixture (i.e., primary polymeric materials, polysaccharide salts) and other optionals also can be admixed into the spray-dried composition, if desired.

The soil removal improvement mixture of the present invention can be incorporated into hard surface cleaning compositions in a variety of forms. However, it is particularly desirable that the mixture be in a form which can readily dissolve or disperse upon dilution of the hard surface cleaner with water. Consequently, preferred hard surface cleaning compositions contain the soil removal improvement mixture mixed throughout the composition in readily dispersible or dissolvable form.

One such dispersible or dissolvable form is provided simply by admixing the surfactant and builder granules with the soil removal improvement mixture in the form of small particles or aggregates ranging from about 10 to about 300 microns in diameter. Particles having average diameters below about 40 microns are preferred.

Alternatively, the soil removal improvement mixture can be melted or dissolved in a solvent such as water and sprayed onto one or more of the hard surface cleaning composition granular components. For example, a molten or aqueous slurry of the soil removal improvement mixture can be sprayed onto an agitated dry mixture of builder and, optionally, surfactant. It is desirable that compositions prepared in this manner exhibit no substantial delay in solubility. Consequently, the layer of the soil removal improvement mixture as a film on the composition granules should be relatively thin and highly water-soluble or dispersible at normal usage temperatures. Usually such a polymer layer is less than about 100 microns in average thickness.

The soil removal improvement mixture can also be used to wholly encapsulate certain hard surface cleaning composition adjuvants such as, for example, perfume. Encapsulation techniques using polymeric materials, including polyvinyl alcohol, are known. (See, for instance, U.S. Pat. No. 3,015,128, issued Jan. 2, 1962 to Somerville, relating to encapsulation of liquids with a mixture of polyvinyl alcohol and alginates. This patent is incorporated herein by reference.) Again, however, it is desirable that the soil removal improvement mixture be in a form which readily dissolves or disperses upon dilution of the cleaning composition. Encapsulation of liquids (perfumes) as disclosed in U.S. Pat. No. 3,015,128 above is particularly desirable for use in granular compositions inasmuch as the built granular hard surface cleaning composition advantageously interacts with the capsule wall promoting dissolution of calcium alginate formed on the surface of the capsules according to the capsule hardening method in the Sommerville patent.

A granular composition herein can, of course, contain the soil removal improvement mixture in several different forms. Thus a composition can contain some of the total soil removal improvement mixture, say 5% to about 50% by weight, in the form of encapsulation material and some, say from about 50% to about 95% by weight, of the material in granular form.

In granular hard surface cleaning compositions it is particularly desirable that the surfactant concentration be below 5% by weight.

b. Liquid Compositions

Liquid compositions can be prepared in aqueous form by simply admixing the soil removal improvement mixture, preferably in dispersed or dissolved aqueous form, with shearing agitation into a conventional liquid hard surface cleaning composition.

Liquid compositions preferably contain from about 0.5% to less than 5% surfactant.

HARD SURFACE CLEANING

Cleaning of hard surfaces using the compositions of the present invention can be accomplished in conventional manner. Generally the composition is diluted with water to form an aqueous cleaning solution. This cleaning solution is then contacted with the surface to be cleaned. A substrate such as a mop, sponge, cloth, brush, etc., is used to oscillate the cleaning composition across the hard surface thereby loosening, dissolving and removing soil.

Cleaning solutions formed from the compositions of the instant invention generally contain from about 50 ppm to 2000 ppm surfactant, from about 50 ppm to 20,000 ppm builder and from about 2 ppm to 1500 ppm of the soil removal improvement mixture.

It is highly preferred that the cleaning solution formed from the compositions herein have a non-acid pH. Thus preferably the instant compositions when dissolved should provide aqueous solutions having a pH within the range of from about 7 to 12, more preferably 9 to 11.

The following exemplifies the hard surface cleaning compositions of this invention and the soil removal benefits achieved by incorporation of the polymeric materials herein into such compositions. These examples are illustrative of the present invention and are not considered as limiting thereof.

EXAMPLE I

The granular hard surface cleaning composition of the following formulation is prepared in conventional manner.

| Component | Weight Percent |
|---|---|
| Surfactant | |
| Sodium $C_{11.8}$ linear alkyl benzene sulfonate (LAS) 0.9% | 1 |
| Sterox CD* (ethoxylated tall oil) 0.1% | |
| Sodium tripolyphosphate | 20 |
| Trisodium phosphate | 20 |
| Sodium sesquicarbonate | 57 |
| Polyvinyl alcohol (Elvanol 90/50**, 99-100% hydrolyzed) | 0.025 |
| Sodium alginate*** | 0.025 |
| Moisture and miscellaneous | Balance |
| | 100 |

*Marketed by Monsanto Company
**Marketed by E. I. Dupont (viscosity of 12–14 cp. at 20°C, 4% by weight aqueous solution and a molecular weight within the range of the herein claimed invention)
***Marketed by Edward Mendell Company as Cecalgine TBV Such a composition can be dissolved in water to the extent of about 1.3% by weight to provide a cleaning solution suitable for effectively removing a variety of soil types from a variety of hard surfaces. Use of such a cleaning solution in conventional manner produces little undesirable solution foaming. Cleaning solutions prepared in this manner from such a composition leave little unsightly filming or streaking on hard surfaces cleaned therewith.

Compositions of substantially similar performance characteristics are realized when in the Example I composition the PVA material is replaced with an equivalent amount of a commercially available polyvinyl pyrrolidone, such as K-60 marketed by GAF Corp., having a degree of polymerization of about 1,500. Substantially similar results are obtained when the sodium alginate is replaced with an equivalent amount of xanthan gum (Biopolymer X-23 marketed by Melle-Bezons Co.) in the above Example I compositions.

SOIL REMOVAL EVALUATION METHOD

The ability of the compositions of the instant invention to remove soil from hard surfaces is evaluated by means of the following procedure. Surfaces consisting of individual linoleum and vinyl asbestos tiles are treated with various types of soil formulated to simulate naturally occurring home cleaning situations. Linoleum (L) and vinyl asbestos (VA) are common flooring materials representative of the types of surfaces encountered by persons cleaning in home and industry. Rectangular tiles of 25.4 cm long and 6.2 cm wide are used in the evaluation.

Standard soil types approximating normal household soils are used in determining cleaning efficacy. One soil is called "particulate soil" (PS) and simulates a street-like soil which contains a mixture of soot, clay, rust, sand, cement and humus combined with a small proportion of greasy/fatty materials. This particulate soil is brushed on the tiles and left to age at room temperature for varying times, usually at least about 1 week.

A second soil employed in evaluation is called "kitchen type soil" (KTS) and comprises a mixture of fatty materials, predominately unsaturated oils, combined with a minor amount of a particulate type soil. This KTS soil is sprayed onto the tiles and then aged at room temperature for relatively long periods, usually at least about 1–2 months. Alternatively, higher temperature aging is used to shorten the time necessary to prepare the soiled tiles.

A third soil used herein is called waxy soil (WS) and has a waxy component consisting of floor wax. This soil further has particulate soil and fatty materials mixed in and is placed on a clean tile with a roller. The tile is usually aged for about 1 week or more at room temperature before testing.

A modified Gardner Washability Machine is employed to simulate normal hard surface washing conditions. Basically, this Washability Machine is a device which holds a sponge having cleaning solution soaked therein onto a tile surface which is to be cleaned. This sponge is then mechanically drawn at constant rate and pressure across the tile to be cleaned, each completed pass being called a stroke. After a predetermined number of passes or strokes, the tile surface is evaluated for cleanliness. Utilization of the modified Gardner Washability Machine allows for each individual soiled tile to be washed with five different cleaning solutions.

Grading experts visually evaluate soil removal performance by comparing soil removal achieved with a standard cleaning composition (Basis) and soil removal achieved with the compositions such as those of the instant invention which further contain the soil removal improvement mixture. Replicate testing is carried out making paired comparisons between individual treatments on a single tile.

The following scale is utilized to quantify the differences between the pairs of cleaned surfaces seen by the visual graders.

VISUAL SCORING SCALE

0 — equal
±1 — I think there is a difference
±2 — I know there is a difference
±3 — I know there is a large difference
±4 — I know there is a very large difference Numerical data obtained from this visual scoring scale are treated statistically by analysis of variance. Positive values indicate greater soil removal from the test tile than from tiles treated with the standard or basis cleaning composition.

EVALUATION RESULTS

Several cleaning solutions are prepared by dissolving compositions substantially similar to those of Example I to the extent of about 1.3% by weight in water of 5 to 7 grains/gallon hardness at 46°C.

Five separate sets of evaluations are made. Soil removal grading results in Grading Scale Units (GSU) are provided in Tables I–V below. The cleaning performance of a solution of a composition similar to that of Example I (except that no primary polymeric material or polysaccharide is added) is used as a standard or basis for comparison by the visual grading experts. Thus, the cleaning performance of this Example I composition (without primary polymeric materials or polysaccharides) is compared to the cleaning performance of aqueous solutions of compositions (similar to Example I compositions) further containing (1) primary polymeric material, (2) polysaccharide salt, (3) primary polymeric material and polysaccharide salt at different levels. The level of the primary polymeric material and/or polysaccharide salt appears in each table as a granular product weight percent. All cleaning comparison results in the Tables are statistically significant from basis (95% confidence) unless so noted as non-significant (NS).

Table I shows evaluations of polyvinyl alcohol (Elvanol 70-05, 99–100% hydrolyzed; a viscosity of 4–6 cp. at 20°C, 4% by weight aqueous solution, and a molecular weight within the scope of the invention herein) and a low viscosity sodium algin (Cecalgine TBV having a molecular weight within the range claimed herein marketed by E. Mendell Company) in hard surface cleaning compositions as compared to a composition without such materials. As can be seen in this table algin provides no significant soil removal benefit while the combination of polyvinyl alcohol and alginate gives a greater soil removal benefit than polyvinyl alcohols alone.

Table II similarly shows evaluation of polyvinyl alcohol (Elvanol 51-05, 88–89% hydrolyzed; viscosity of 4–6 cp. at 20°C, 4% aqueous solution, and a molecular weight within the scope of the invention herein) and high viscosity xanthan gums (Biopolymer XB-23 having a molecular weight within the range claimed herein marketed by Melle-Bezons Co.) in hard surface cleaning compositions.

Table III shows the evaluation of polyvinyl pyrrolidone (K-15 having a Mol. Weight 10,000 and marketed by GAF Corp.) along with algin (Cecalgine TBV marketed by Edward Mendell Co.) in hard surface cleaning compositions. While this polyvinyl pyrrolidone at this particular level does not provide a significant benefit alone, the combination of polyvinyl pyrrolidone and alginate does.

Tables IV and V show an evaluation of polyvinyl pyrrolidones of different molecular weights in hard surface cleaning compositions. Table IV shows evaluation of polyvinyl pyrrolidone (K-60 having a Mol. Wt. 160,000, marketed by GAF Corp.) and algin (Cecalgine TBV marketed by Edward Mendell Co.).

Table V shows evaluation of the soil removal performance of polyvinyl pyrrolidone (K-90 having a Mol. Wt. 360,000 marketed by GAF Corp.) and alginate (Cecalgine TBV marketed by Edward Mendell Co.).

As can be seen by examination of these tables soil removal improvement mixtures generally provide improved soil removal when added to the hard surface cleaning compositions herein.

TABLE I

| Composition | Additive Type | Additive Level | Soil Removal from Floor Tile/Soil Combinations L/WS (gsu) | VA/WS (gus) | L/KTS (gsu) |
|---|---|---|---|---|---|
| Standard | — | — | Basis | Basis | Basis |
| | +PVA | 0.05% | 1.6 | 1.4 | 0.9 |
| | +Algin | 0.05 | 0.1 (NS) | 0.5 | −0.9 |
| | +PVA Algin | 0.025 0.025 | 2.5 | 2.2 | 1.4 |
| | +PVA Algin | 0.05 0.05 | 3.7 | 3.9 | 2.8 |

TABLE II

| Composition | Additive Type | Additive Level | Soil Removal from Floor Tile/Soil Compositions L/WS (gsu) | VA/WS (gsu) | L/KTS (gsu) | L/PS (gsu) |
|---|---|---|---|---|---|---|
| Standard | — | — | Basis | Basis | Basis | Basis |
| | +PVA | 0.05 | 2.0 | 1.3 | 1.6 | 1.8 |
| | +Xanthan Gum | 0.05 | 0.4 (NS) | −0.9 | 1.2 | 1.2 |
| | +PVA Xanthan Gum | 0.025 0.025 | 2.3 | 2.0 | 2.1 | 2.3 |
| | +PVA Xanthan Gum | 0.05 0.5 | 3.6 | 3.2 | 3.3 | 3.6 |

TABLE III

| Composition | Additive Type | Additive Level | Soil Removal from Floor Tile/Soil Combinations L/WS (gsu) | L/KTS (gsu) | L/PS (gsu) |
|---|---|---|---|---|---|
| Standard | — | — | Basis | Basis | Basis |
| | +PVP* | 0.05 | 0.1 (NS) | 0.4 (NS) | 0.8 (NS) |
| | +PVP* Algin | 0.025 0.025 | 1.8 | 2.8 | 2.6 |
| | +PVP* Algin | 0.05 0.05 | 2.6 | 2.2 | −0.3 (NS) |
| | +PVA** Algin | 0.025 0.025 | 2.2 | 2.8 | 0.5 (NS) |

*K-15; molecular weight of 10,000
**Elvanol 90–50 as previously described

TABLE IV–V

| Composition | Additive Type | Additive Level | Soil Removal from Linoleum Floor Tile/Waxy Soil Combination L/WS (gsu) | L/WS (gsu) |
|---|---|---|---|---|
| Standard | — | — | Basis | Basis |
| | +PVP | 0.05 | 1.6* | 1.4** |
| | +PVP Algin | 0.025 0.025 | 2.5* | 2.4** |
| | +PVP Algin | 0.05 0.05 | 1.9* | 1.8** |
| | +PVA Algin | 0.025 0.025 | 1.7*** | 2.1*** |

*PVP is K-60; molecular weight of 160,000
**PVP is K-90; molecular weight of 360,000
***PVA is Elvanol 90–50

EXAMPLE II

The following granular phosphate-free composition is prepared.

| Component | Weight Percent |
|---|---|
| Sodium citrate | 12 |
| Sodium carbonate | 20 |
| Sodium sesquicarbonate | 40 |
| Sodium sulfate | 26 |
| Surfactant Sodium $C_{12}$ linear alkyl benzene sulfonate 0.9% Sterox CD (polyoxyethylene ester of tall oil)* 0.1% | 1 |
| Perfume capsule shell materials | |
| Polyvinyl alcohol (Elvanol 51–05)** | 0.5 |
| Sodium/calcium alginate*** | 0.5 |
| Water, perfume and miscellaneous | Balance to 100% |

*Marketed by Monsanto Corp.
**Marketed by E. I. Dupont (as previously described)
***Marketed by Edward Mendell Co. as Cecalgine TBV The polyvinyl alcohol and sodium/calcium alginate of this composition comprise shell materials encapsulating liquid perfume. The encapsulated perfume is prepared in a manner similar to that disclosed in U.S. Pat. No. 3,310,612 issued Mar. 21, 1967 to Sommerville (This patent is incorporated herein by reference). These capsules are hardened as in this Sommerville patent with a $CaCl_2$ hardening bath.

This Example II composition is found to remove soil more effectively from hard surfaces than a corresponding composition that does not contain the soil removal improvement mixture when such compositions are used in a conventional manner.

What is claimed is:

1. A hard surface cleaning composition comprising:

a. from about .05% to about 15% by weight of a surfactant selected from the group consisting of anionic, nonionic, ampholytic, and zwitterionic surfactants and mixtures thereof;

b. from about 0.5% to about 99% by weight of a builder selected from the group consisting of organic and inorganic builders and mixtures thereof; and c. from about 0.03% to about 5.0% by weight of a soil removal improvement mixture comprising 1. a water-soluble or dispersible nonionizing primary polymeric material selected from the group consisting of i. polyvinyl alcohols having a degree of hydrolysis from about 60% to about 100% and a degree of polymerization of from about 100 to about 7000;

ii. polyvinyl pyrrolidones having a degree of polymerization of from about 50 to about 6000; and iii. mixtures thereof; and 2. an ionizing polysaccharide salt selected from the group consisting of seaweed extracts, plant exudates, seed gums, plant extracts, animal extracts, and biosynthetic gums; the weight ratio of primary polymeric material to polysaccharide salt ranging from about 4:1 to about 1:4.

2. A composition according to claim 1 wherein the composition is granular and wherein the surfactant comprises less than 5% by weight of the composition.

3. A composition according to claim 2 wherein the surfactant is primarily anionic by weight.

4. A composition according to claim 3 wherein the primary polymeric material is polyvinyl alcohol.

5. A composition according to claim 4 wherein the polysaccharide salt is selected from the group consisting of alginates, carrageenan, gum arabic, xanthan gum and mixtures thereof.

6. A composition according to claim 1 wherein the soil removal improvement mixture comprises from about 0.05% to about 2% by weight of the composition.

7. A composition according to claim 6 wherein the surfactant is anionic and comprises from about 0.5% to less than 5% by weight of the composition; the builder is the alkali metal salt of an anionic moiety selected from the group consisting of carbonates, phosphates, polyphosphates, sesquicarbonates, bicarbonates, citrates, silicates, and mixtures thereof; the primary polymeric material is polyvinyl alcohol; and the weight ratio of primary polymeric material to polysaccharide salt within the soil removal improvement mixture varies from about 2:1 to about 1:2.

8. A composition according to claim 7 which composition additionally contains a perfume material wherein the polyvinyl alcohol and polysaccharide salt comprise shell materials for said perfume material.

9. A composition according to claim 8 wherein the polysaccharide salt comprises a mixture of sodium and calcium alginates.

10. A method of cleaning a hard surface, said method comprising:

a. contacting a hard surface having soil thereon with an aqueous solution, containing, 1. from about 50 ppm to about 2000 ppm of a surfactant selected from the group consisting of anionic, nonionic, ampholytic, and zwitterionic surfactants and mixtures thereof 2. from about 50 ppm to about 20,000 ppm of a builder selected from the group consisting of inorganic and organic builders and mixtures thereof;

3. from about 2 to about 1500 ppm of a soil removal improvement mixture comprising i. a water-soluble or dispersible nonionizing primary polymeric material selected from the group consisting of polyvinyl alcohols having a degree of hydrolysis of from about 60% to about 100% and a degree of polymerization of from about 100 to about 7000; polyvinyl pyrrolidones having a degree of polymerization of from about 50 to about 6000; and mixtures thereof; and ii. an ionizing polysaccharide salt selected from the group consisting of seaweed extracts, plant exudates, seed gums, plant extracts, animal extracts, and biosynthetic gums; the weight ratio of primary polymeric material to polysaccharide salt in ionized form ranging from about 4:1 to about 1:4; and b. oscillating the aqueous solution across the surface to remove the soil thereon.

* * * * *